United States Patent [19]

Dollison

[11] Patent Number: 4,969,515

[45] Date of Patent: Nov. 13, 1990

[54] EXPENDABLE DEVICES FOR WELL LOCK SYSTEM

[75] Inventor: William W. Dollison, Dallas, Tex.

[73] Assignee: Otis Engineering Corporation, Dallas, Tex.

[21] Appl. No.: 449,807

[22] Filed: Dec. 13, 1989

[51] Int. Cl.[5] ..... E21B 33/12

[52] U.S. Cl. ..... 166/133; 166/188

[58] Field of Search ..... 166/380, 115, 133, 188

[56] References Cited

U.S. PATENT DOCUMENTS

| | | | |
|---|---|---|---|
| 2,994,280 | 8/1961 | Daffin | 166/133 |
| 3,180,420 | 4/1965 | Mason, Jr. et al. | 166/133 |
| 3,250,331 | 5/1966 | Boyle | 166/133 |
| 4,355,686 | 10/1982 | Arendt et al. | 166/313 |
| 4,360,063 | 11/1982 | Kilgore | 166/317 |
| 4,630,833 | 12/1986 | Boyle et al. | 277/188 A |
| 4,718,488 | 1/1988 | Pringle et al. | 166/135 |

OTHER PUBLICATIONS

Otis Engineering Corporation; TFL/Pumpdown and Completion Equipment and Services Catalogue, pp. 266 & 278; 1985.

*Primary Examiner*—William P. Neuder
*Attorney, Agent, or Firm*—Roland O. Cox

[57] ABSTRACT

A lock system for wells which includes a landing nipple in the well tubing and two embodiments of a lock mandrel, which are sealingly engageable and releasably lockable in the landing nipple to control flow through the well tubing. One lock mandrel is closed to flow and "plugs" the landing nipple. The other lock mandrel, which will operate as a standing valve, has a through flow passage and a check valve preventing downward flow through the flow passage and lock mandrel. Both lock mandrels utilize "C" rings for locking in landing nipples and may be released for expending downwardly from landing nipples by a predetermiend downward force.

29 Claims, 2 Drawing Sheets

EXPENDABLE DEVICES FOR WELL LOCK SYSTEM

BACKGROUND OF THE INVENTION

This invention pertains to a locking system utilizing expendable lock mandrels, which sealingly engage and releasably lock in landing nipples in well tubing to control flow through the tubing.

A number of types of expendable devices have been developed for use in landing nipples in well tubing for flow control purposes. One of these devices, an expendable standing valve, is currently available and is shown on page 266 of "General Sales Catalog" (OEC 5338), a publication of Otis Engineering Corporation, P.O. Box 819052, Dallas, Tex. 75381-9052. This standing valve seals and releasably locks in a landing nipple and permits upward flow and prevents downward flow through the valve.

U.S. Pat. No. 4,355,686 for WELL SYSTEM AND METHOD covers the use of expendable fluid control means, such as standing valves, in landing nipples in two tubing strings in an injection well. Another U.S. Pat. No. 4,360,063 for VALVE covers an expendable standing valve type flow control which is expended from a nipple by two applications of pressure. U.S. Pat. No. 4,718,488, discloses a pump-out plug which may be seated in a landing nipple having a landing sub in a well conduit. This plug may be closed, preventing flow through in both directions and the plug and landing sub may be expelled by pressure.

Yet another U.S. Pat. No. 3,250,331 for LOCKING DEVICE FOR WELL TOOLS discloses a locking device utilizing an expandable locking member in the form of a coil spring or split ring for releasably locking this device in a landing nipple in a flow conductor. This locking device when sealed and releasably locked in a landing nipple essentially "plugs" the landing nipple by preventing upward flow and permitting very small volume downward flow through an internal equalizing valve. This locking device cannot be expended downwardly from its landing nipple.

SUMMARY OF THE INVENTION

Disclosed is a lock system useful in wells and which includes a landing nipple at the proper level in well tubing and lock mandrels sealingly engageable and releasably lockable in the landing nipple to control flow through the landing nipple and well tubing. The landing nipples have upper and lower internal shoulders and a seal surface between shoulders. One preferred embodiment of the lock mandrel plugs the landing nipple and prevents flow in either direction through the landing nipple. This lock mandrel may be dropped or lowered down tubing on wire line to the landing nipple.

Another preferred lock mandrel embodiment operates as a standing valve and permits upward flow through the lock mandrel. A check valve in the standing valve version prevents downward flow through this lock mandrel. This lock mandrel may be dropped, pumped down or lowered on wire line in tubing to its landing nipple.

Both lock mandrels have fishing necks on their upper ends and utilize upper and lower locking rings expanded above and below the landing nipple shoulders for releasably locking in landing nipples. The plug mandrel when sealed and locked in a landing nipple will withstand very high pressure thrust from below and limited pressure thrust from above. The standing valve version when sealed and locked will withstand limited pressure thrust from above. If either the plug mandrel or standing valve mandrel are only required to withstand pressure from above and not from below when sealed and locked in their landing nipples, the lower locking rings may be left off. Either lock mandrel may be released and expended downwardly from landing nipples by applying a downward force on the lock mandrel sufficient to shear screws positioning a retaining ring to hold the upper locking ring in expanded position.

BRIEF DESCRIPTION OF THE DRAWING

FIG. 1 shows the preferred plug embodiment of the lock mandrel 10 of this invention sealingly engaged and locked in a landing nipple 11. The landing nipple is connectible in well tubing and has upper and lower internal shoulders **11*a* and 11*b* and seal surface 11*c*. A connector bolt 12 has been passed through holes in disk 13, upper body 14 and lower body 15 and threadedly connected into guide 16. The connector bolt has an external fishing neck 12*a* on its upper end and a resilient seal 17 seals the lower body around the bolt. The upper body has a larger diameter 14*a* and a smaller diameter 14*b*. Disposed around diameter 14*a* is an upper expanded "C" shaped lock ring 18. Releasably positioned around diameter 14*b* by at least one shearable screw 19 is a retainer ring 20, which retains lock ring 18 around diameter 14*a* in expanded position. A resilient interference seal ring 21 of one of the types shown in U.S. Pat. No. 4,630,833, sealingly engages the body and seal surface 11*c*, sealing lock mandrel 10 in landing nipple 11. Guide 16 has a smaller diameter 16*a* and a downwardly and outwardly tapering frusto-conical surface 16*b*, around which is disposed a lower expanded "C" ring 18**.

Figure 3:
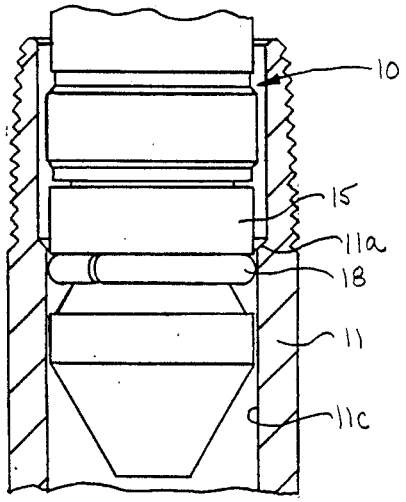
FIG. 3 is a fragment of an elevational drawing partially in section, showing the lock mandrel lower locking ring retracted as the lock mandrel is lowered into the landing nipple.

To use the look system of this invention which utilizes the plug embodiment of the lock mandrel 10, landing nipple 11 should be connected in the well tubing at the proper level as tubing is run into the well. Lock mandrel 10 may be dropped, lowered on wireline or pumped down well tubing until lower "C" ring 18 lands on upper landing nipple shoulder **11*a*, a smaller guide diameter 16*a* has moved inside the lower ring and the lower end of lower body 15 rests on the lower ring. Now, applying weight on or pumping fluid downwardly in the tubing to exert sufficient downward force on lock mandrel 10 and lower body 15 to cause ring 18 to be retracted by landing nipple shoulder 11*a* and moved downwardly into seal surface 11*c* as shown in FIG. 3. As lock mandrel 10 is moved further downwardly into seal surface 11c, seal 21 enters and seals in seal surface 11c, lower ring 18 (if used) returns to expanded position below lower landing nipple shoulder 11b and upper ring 18 lands on upper landing nipple shoulder 11a stopping downward movement of the lock mandrel in the landing nipple. Lock mandrel 10 is now sealingly engaged and locked in landing nipple 11. Downward or pressure force from above does not move lock mandrel 10 downwardly as larger diameter 14a retains upper lock ring 18 in expanded position so that downward forces are transmitted through upper ring 18 into landing nipple shoulder 11a. If lower ring 18 is used, any forces on lock mandrel 10 from below move the lock mandrel and tapered surface 16b up until surface 16b contacts the inside of lower lock ring 18 and urges it to expand further out under lower landing nipple shoulder 11b and transmits the upward forces through ring 18 into lower shoulder 11b. If lower ring 18 was left off lock mandrel 10, this lock mandrel will be moved upwardly out of sealing engagement with landing nipple 11 by pressure from below and lower shoulder 11b is not required in landing nipple 11**.

Figure 4:
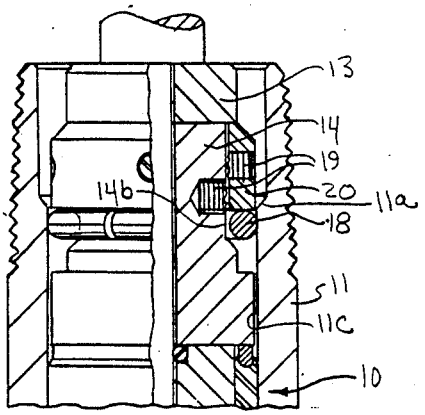
FIG. 4 is a fragment of an elevational drawing partially in section, showing the upper locking ring released and retracted as the lock mandrel is being expended downwardly through the landing nipple.

When it is desirable to release lock mandrel 10 from landing nipple 11 and expend the lock mandrel downwardly and out of the landing nipple, a downward force sufficient to shear screws 19 is applied on the lock mandrel. The lock mandrel and upper body 14 moves downwardly in retainer ring 20 until disk 13 contacts the upper end of ring 20 and smaller diameter 14b is inside upper lock ring 18 as shown in FIG. 4. Continued downward force will cause upper landing nipple shoulder 11a to retract the upper lock ring and move it into seal surface 11c and permit lock mandrel 10 to be moved downwardly through and expended from landing nipple 11.

Figure 1:
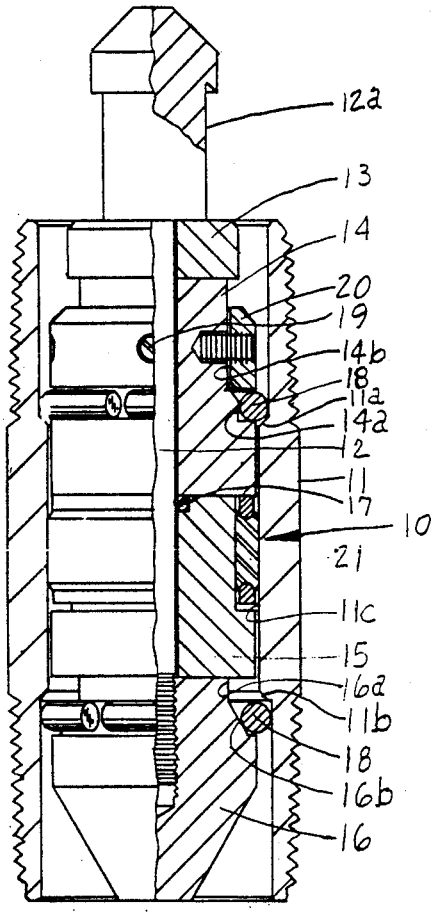
FIG. 1 is an elevational drawing in half section, showing the lock system of this invention in which an expendable plug type lock mandrel is sealingly engaged and locked in a landing nipple.
Figure 2:
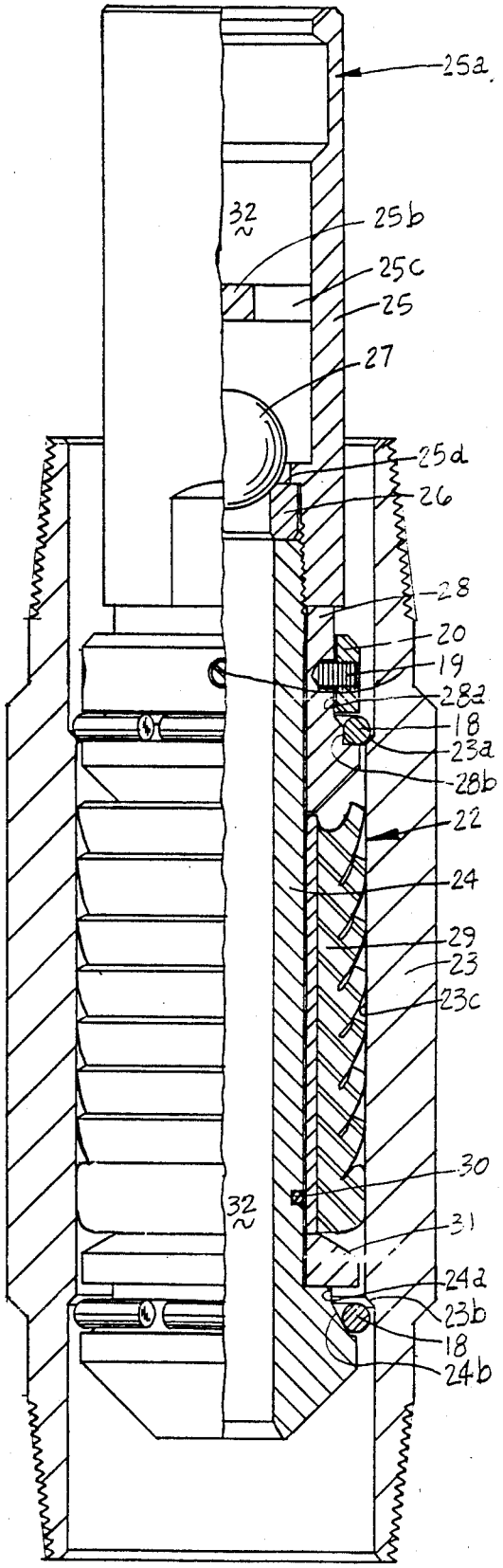
FIG. 2 is an elevational drawing in half section, showing the lock system of this invention in which an expendable standing valve type lock mandrel is sealingly engaged and locked in a landing nipple.

FIG. 2 shows the preferred standing valve embodiment of the lock mandrel 22 of this invention sealingly engaged and locked in landing nipple 23. The landing nipple is connectable in well tubing and has upper and lower internal shoulders 23a and 23b and seal surface 23c. Connected on the upper end of mandrel 24 is a housing 25. An internal fishing neck 25a has been formed in the upper end of the housing. A partition 25b has been formed in the housing. The partition has at least one opening 25c. The housing has a shoulder 25d which positions the lower end of annular seat 26 in sealing engagement with the upper end of the mandrel and captures valve ball 27 between the partition and seat when the housing is connected on mandrel 24.

A body 28 is mounted around mandrel 24. This body has a smaller diameter 28a and a larger diameter 28b. An upper expanded "C" lock ring 18 is retained in expanded position on the larger diameter by retainer ring 20, which is positioned around the smaller diameter by at least one shearable screw 19. Also mounted around the mandrel is a piston unit 29, which is sealed to the mandrel with resilient seal 30. A spacer ring 31 is mounted around the mandrel between the piston unit and a shoulder on the mandrel. A piston unit is shown on page 278 of the aforementioned "General Sales Catalog" publication of Otis Engineering Corporation. The mandrel has a smaller diameter 24a and a downwardly and outwardly tapering surface 24b. A lower expanded "C" lock ring is mounted around surface 24b. Lock mandrel 22 has a longitudinal flow passage 32.

To use the lock system of this invention which utilizes the standing valve embodiment of the lock mandrel 22, landing nipple 23 should be connected in the well tubing string at the proper level as tubing is run into the well. Lock mandrel 22 may be dropped, lowered on wireline or pumped down the tubing to sealingly engage and lock in the landing nipple and prevent downward flow and permit upward flow in passage 32. As lock mandrel 22 moves downwardly into landing nipple 23, lower ring 18 (if used) lands on upper landing nipple shoulder 23a, smaller mandrel diameter 24a has moved inside the lower ring and the lower end of spacer ring 31 rests on the lower ring. The application of weight on this lock mandrel or pumping fluid downwardly in the tubing will exert sufficient force downwardly on mandrel 24 and ring 31 to cause ring 18 to be retracted by landing nipple shoulder 23a and moved downwardly into seal surface 23c (Same as for lock mandrel 10, see FIG. 3). As lock mandrel 22 is moved further downwardly into seal surface 23c, piston unit 29 enters and seals in seal surface 23c, lower ring 18 (if used) returns to expanded position below lower landing nipple shoulder 23b and upper ring 18 lands on upper landing nipple shoulder 23a stopping downward movement of the lock mandrel in the landing nipple.

Lock mandrel 22 is now sealingly engaged and locked in landing nipple 23. Any flow downward from above in flow passage 32 moves valve ball 27 downwardly into sealing engagement on annular seat 26 preventing downward flow in passage 32. Conversely, upward flow from below lifts ball 27 from seat 26 and upward flow in passage 32 through opening 25c may occur. Limited downward or pressure force from above does not move lock mandrel 22 downwardly as larger diameter 28b retains upper lock ring 18 in expanded position so that downward forces are transmitted through upper ring 18 into landing nipple shoulder 23a. If lower ring 18 is used, any forces on lock mandrel 22 from below move the lock mandrel and tapered surface 24b up until surface 24b contacts the inside of lower lock ring 18 and urges it to expand further out under lower landing nipple shoulder 23b. If lower ring 18 was not used on lock mandrel 22, this lock mandrel will be moved upwardly out of sealing engagement with landing nipple 11 by pressure from below and lower shoulder 23b is not required in landing nipple 23.

When it is desirable to release lock mandrel 22 from landing nipple 23, and expend the lock mandrel downwardly, a downward force sufficient to shear screws 19 is applied on the lock mandrel. The lock mandrel and body moves downwardly in retainer ring 20 until the lower end of housing 25 contacts the upper end of ring 20 and smaller diameter 28a is inside upper lock ring 18. Continued downward force will cause upper landing nipple shoulder 23a to retract the upper lock ring and move it into seal surface 23c and permit lock mandrel 22 to be moved downwardly through and expended from landing nipple 23 (Same as for lock mandrel lo, See FIG. 4).

What is claimed is:

1. An expendable lock system for wells comprising:

(a) a landing nipple in tubing in the well, said landing nipple having an upper internal shoulder therein and a sealing surface therebelow; and (b) lock mandrel means for withstanding a predetermined pressure from above and sealingly engaging said landing nipple, said lock mandrel means including:

sealing means thereon for sealingly engaging said landing nipple sealing surface, upper locking ring means engageable with said landing nipple upper shoulder for preventing downward movement of said lock mandrel means in said landing nipple, and releasing means responsive to a predetermined downward force on said lock mandrel means for releasing said lock mandrel means for downward movement in said landing nipple.

2. The system of claim 1 wherein the lock mandrel means is closed to flow therethrough and has an external fishing neck thereon.

3. The system of claim 1 wherein the lock mandrel means has an internal fishing neck therein, a flow passage therethrough and a check valve in said flow passage, said check valve permitting upward flow and preventing downward flow.

4. A lock mandrel for withstanding a predetermined pressure from above and sealingly engaging a landing nipple comprising:

(a) a body having a fishing neck on the upper end thereof;

(b) sealing means on said body for sealingly engaging said landing nipple;

(c) upper locking ring means for preventing downward movement of said lock mandrel in said landing nipple; and (d) releasing means releasable in response to a predetermined downward force on said lock mandrel for releasing said lock mandrel for downward movement in said landing nipple.

5. The lock mandrel of claim 4 wherein the seal means is at least one resilient interference type seal and said lock mandrel is closed to flow therethrough.

6. The lock mandrel of claim 5 wherein the fishing neck is the external type.

7. The lock mandrel of claim 4 having a flow passage therethrough and a check valve in said flow passage, said check valve permitting upward flow and preventing downward flow.

8. The lock mandrel of claim 7 wherein the fishing neck is the internal type.

9. The lock mandrel of claim 7 wherein the sealing means comprises:

(a) a sleeve; and (b) resilient material having a number of annular fins bonded around said sleeve.

10. The lock mandrel of claim 4 wherein the upper locking ring means comprises:

(a) an expanded "C" locking ring around the body above the seal means;

(b) a larger diameter on said body for holding said "C" ring in expanded position, said "C" ring movable to around a smaller diameter on said body and to a retracted position.

11. The lock mandrel of claim 4 wherein the releasing means comprise:

(a) a retainer ring around the body retaining the upper "C" ring on the larger diameter in expanded position; and (b) shearable means positioning said retainer ring on said body.

12. A lock mandrel for withstanding a predetermined pressure from above and sealingly engaging a landing nipple, said lock mandrel closed to flow therethrough comprising:

(a) a body having an external type fishing neck on the upper end thereof;

(b) resilient interference type seal means on said body for sealingly engaging said landing nipple;

(c) upper locking ring means on said body including:

an expanded "C" locking ring around said body above said seal means, a larger diameter on said body for holding said "C" ring in expanded position, said "C" ring moveable to around a smaller diameter on said body and to a retracted position; and (d) releasing means on said body releasable in response to a predetermined downward force on said body including:

a retainer ring around said body retaining said upper "C" ring on said larger diameter in expanded position, and shearable means positioning said retainer ring on said body.

13. A lock mandrel for withstanding a predetermined pressure from above and sealingly engaging a landing nipple, said locking mandrel having a flow passage therethrough comprising:

(a) a body having an internal type fishing neck on the upper end thereof;

(b) seal means on said body for sealingly engaging said landing nipple, said seal means including resilient material having a number of annular fins bonded around a sleeve;

(c) upper locking ring means on said body including:

an expanded "C" locking ring around said body above said seal means, a larger diameter on said body for holding said "C" ring in expanded position, said "C" ring moveable to around a smaller diameter on said body and to a retracted position;

(d) releasing means on said body releasable in response to a predetermined downward force on said body including:

a retainer ring around said body retaining said upper "C" ring on said larger diameter in expanded position, and shearable means positioning said retainer ring on said body.

14. The lock mandrel of claim 13 further including a check valve in the flow passage, said check valve permitting upward flow and preventing downward flow.

15. An expendable lock system for wells comprising:

(a) a landing nipple in tubing in the well, said landing nipple having spaced apart upper and lower internal shoulders therein and a sealing surface therebetween said shoulders; and (b) lock mandrel means for releasably locking in and sealingly engaging said landing nipple, said lock mandrel means including:

sealing means thereon for sealingly engaging said landing nipple sealing surface, upper and lower locking ring means engageable with said landing nipple upper and lower shoulders for locking said lock mandrel means in said landing nipple, and releasing means responsive to a predetermined downward force on said lock mandrel means for unlocking said lock mandrel means from said landing nipple.

16. The system of claim 15 wherein the mandrel means is closed to flow therethrough and has an external fishing neck thereon.

17. The system of claim 15 wherein the lock mandrel means has an internal fishing neck therein, a flow passage therethrough and a check valve in said flow passage, said check valve permitting upward flow and preventing downward flow.

18. A lock mandrel for sealingly engaging and releasably locking in a landing nipple comprising:

(a) a body having a fishing neck on the upper end thereof;

(b) sealing means on said body for sealingly engaging said landing nipple;

(c) upper and lower locking ring means for locking said lock mandrel in said landing nipple; and (d) releasing means releasable in response to a predetermined downward force on said lock mandrel for unlocking said lock mandrel from said landing nipple.

19. The lock mandrel of claim 18 wherein the seal means is at least one resilient interference type seal and said lock mandrel is closed to flow therethrough.

20. The lock mandrel of claim 19 wherein the fishing neck is the external type.

21. The lock mandrel of claim 18 having a flow passage therethrough and a check valve in said flow passage, said check valve permitting upward flow and preventing downward flow.

22. The lock mandrel of claim 21 wherein the fishing neck is the internal type.

23. The lock mandrel of claim 21 wherein the sealing means comprises:

(a) a sleeve; and (b) resilient material having a number of annular fins bonded around said sleeve.

24. The lock mandrel of claim 21 wherein the upper locking ring means comprises:

(a) an expanded "C" locking ring around the body above the seal means;

(b) a larger diameter on said body for holding said "C" ring in expanded position, said "C" ring movable to around a smaller diameter on said body and to a retracted position.

25. The lock mandrel of claim 18 wherein the lower locking ring means comprises:

(a) an expanded "C" locking ring around said body below the seal means;

(b) a downwardly and outwardly tapering surface on said body for holding said "C" ring in expanded position, said "C" ring moveable to around a smaller diameter on said body and a retracted position.

26. The lock mandrel of claim 18 wherein the releasing means comprise:

(a) a retainer ring around the body retaining the upper "C" ring on the larger diameter in expanded position; and (b) shearable means positioning said retainer ring on said body.

27. A lock mandrel for sealingly engaging and releasably locking in a landing nipple, said lock mandrel closed to flow therethrough comprising:

(a) a body having an external type fishing neck on the upper end thereof;

(b) resilient interference type seal means on said body for sealingly engaging said landing nipple;

(c) upper locking ring means on said body including: an expanded "C" locking ring around said body above said seal means, a larger diameter on said body for holding said "C" ring in expanded position, said "C" ring moveable to around a smaller diameter on said body and to a retracted position;

(d) lower locking ring means on said body including: an expanded "C" locking ring around said body below said seal means; a downwardly and outwardly tapering surface on said body for holding said "C" ring in expanded position, said "C" ring moveable to around a smaller diameter on said body and a retracted position; and (e) releasing means on said body releasable in response to a predetermined downward force on said body including: a retainer ring around said body retaining said upper "C" ring on said larger diameter in expanded position, and shearable means positioning said retainer ring on said body.

28. A lock mandrel for sealingly engaging and releasably locking in a landing nipple, said locking mandrel having a flow passage therethrough comprising:

(a) a body having an internal type fishing neck in the upper end thereof;

(b) seal means on said body for sealingly engaging said landing nipple, said seal means including resilient material having a number of annular fins bonded around a sleeve;

(c) upper locking ring means on said body including:
an expanded "C" locking ring around said body above said seal means,
a larger diameter on said body for holding said "C" ring in expanded position, said "C"ring moveable to around a smaller diameter on said body and to a retracted position;

(d) lower locking ring means on said body including:
an expended "C" locking ring around said body below said seal means;
a downwardly and outwardly tapering surface on said body for holding said "C" ring in expanded position, said "C" ring moveable to around a smaller diameter on said body and a retracted position; and (e) releasing means on said body releasable in response to a predetermined downward force on said body including:
a retainer ring around said body retaining said upper "C" ring on said larger diameter in expanded position; and
shearable means positioning said retainer ring on said body.

29. The lock mandrel of claim 28 further including a check valve in the flow passage, said check valve permitting upward flow and preventing downward flow.

* * * * *